United States Patent [19]

Prater

[11] Patent Number: 4,746,019

[45] Date of Patent: May 24, 1988

[54] END FILL MICROWAVABLE AND/OR OVENABLE CONTAINER

[75] Inventor: Donald R. Prater, Beaverton, Oreg.

[73] Assignee: Ridgeway Packaging Corp., Redmond, Wash.

[21] Appl. No.: 40,255

[22] Filed: Apr. 20, 1987

[51] Int. Cl.[4] ..... B65D 5/54

[52] U.S. Cl. ..... 206/625; 206/607; 206/611; 206/628

[58] Field of Search ..... 206/607, 608, 611, 625, 206/626, 628, 634

[56] References Cited

U.S. PATENT DOCUMENTS

| | | | |
|---|---|---|---|
| 2,828,060 | 3/1958 | Brown | 206/628 |
| 2,973,086 | 2/1961 | Thompson | 206/628 |
| 4,584,202 | 4/1986 | Roccaforte | 206/611 |
| 4,687,104 | 8/1987 | Ielmini | 206/611 |

FOREIGN PATENT DOCUMENTS

| | | | |
|---|---|---|---|
| 687951 | 6/1964 | Canada | 206/626 |
| 1079240 | 6/1980 | Canada | 206/626 |
| 1009558 | 5/1957 | German Democratic Rep. | 206/625 |
| 279927 | 10/1927 | United Kingdom | 206/607 |

*Primary Examiner*—Stephen Marcus
*Assistant Examiner*—Gary E. Elkins
*Attorney, Agent, or Firm*—Christensen, O'Connor, Johnson & Kindness

[57] ABSTRACT

A container that is filled with a product through an open end and which is suitable for use in a microwave or conventional oven to hold the product while it is heated. The container is formed of a paperboard blank coated with polyethylene (microwavable) or polyester (microwavable and ovenable), and is folded, filled and thermally sealed on a slightly modified, but generally conventional machine that is otherwise used to assemble and fill prior art end filled containers. The blank includes a first panel having two end walls, front and rear sidewalls, and four gusset corners, and a second panel connected to the rear sidewall along a fold line having two end flaps, and a front flap. A tear-open access flap is defined on the second panel by partially die cut lines. In a first embodiment, the first panel is imprinted with graphics and the second panel with cooking instructions. As displayed for sale, the graphics on the top of the container are visible, while during the heating process, the container is inverted, making the instructions readily visible. A novel design enables tight reclosure of the access flap by insertion of a reclosure tab into a slotted receiver; an interference fit between the access flap and front fold line "shoulders", and between the tap and the slot holds the access flap tightly closed. In a second embodiment, the graphics are on the top of the container as it is oriented for both sale and for heating the products. In addition, the access flap cannot be tightly reclosed. However, both embodiments permit direct heating in an oven, a benefit only previously available in top filled containers.

12 Claims, 9 Drawing Sheets

Fig. 15.
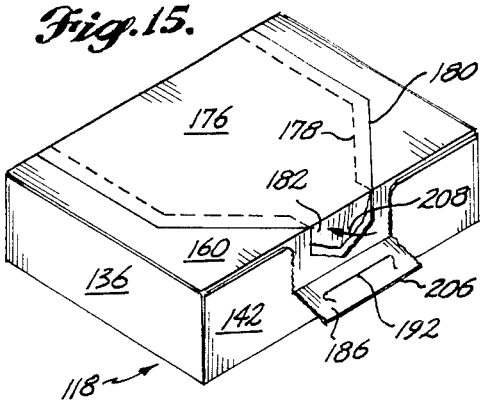
Fig. 16.
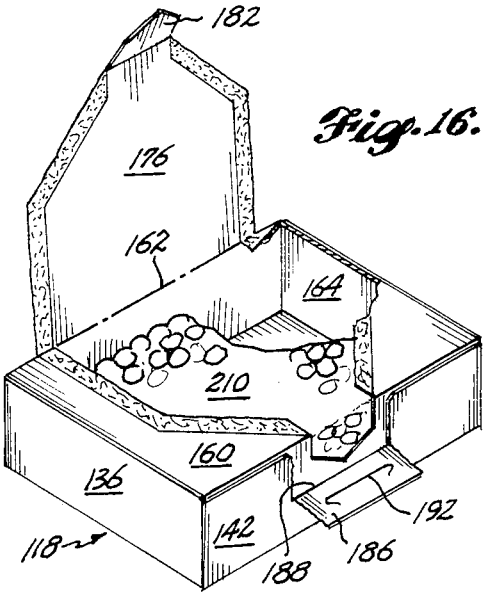
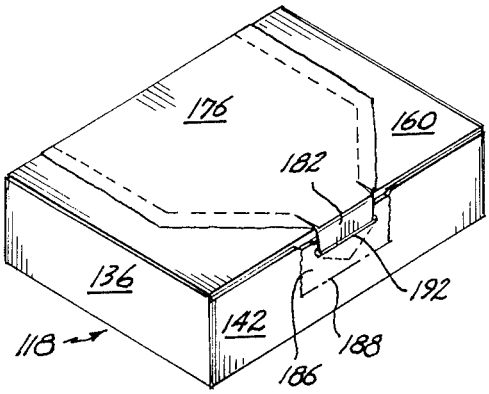
Fig. 17.
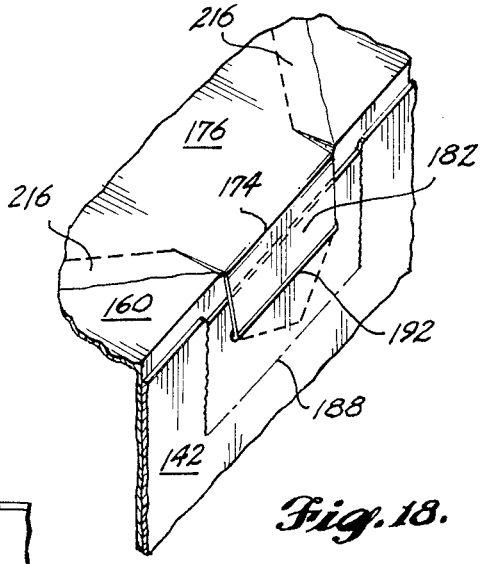
Fig. 18.
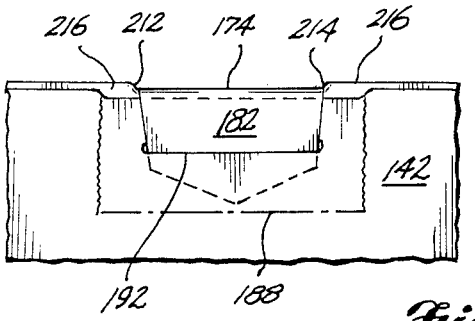
Fig. 19.

END FILL MICROWAVABLE AND/OR OVENABLE CONTAINER

TECHNICAL FIELD

The present invention generally pertains to a container designed to be filled with a consumable product through an open end and sealed, and specifically to a new and novel container in which the product may be heated directly in a microwave or conventional oven, and accessed by the consumer through a reclosable, tear-open flap.

BACKGROUND OF THE INVENTION

Most frozen vegetables are sold to the consumer packaged either in relatively large plastic bags intended for freezer storage as portions of the product are heated and consumed, or in smaller cartons enclosing a quantity generally appropriate for consumption by a typical family at one meal. The cartons are typically constructed of blanked waterproof paperboard that is coated with polyethylene plastic or wax and include flaps that are folded and secured with an adhesive to hermetically seal the container, thereby ensuring product freshness.

Recognizing that it is desirable to minimize the number of dishes required in preparing a meal, microwavable and/or ovenable food packaging containers have been developed that may be placed directly in an oven for heating their enclosed product. Containers such as these may be folded from a blank which includes gusseted corners so that the bottom of the container thus constructed forms a leakproof tray. After the container is filled with the food product through the open top, the top is closed over the food and sealed to the lower portion. The top typically includes a flap that may be torn back by the consumer to expose the product and/or to add water, butter or seasonings either during or before starting the cooking process. A tab on the end of the flap may be inserted into a slot provided on the front sidewall of the container, leaving a wedge-shaped gap between the flap and the top through which steam may escape. Although certain food products may require that steam be allowed to escape during the cooking process, for the majority of food products, allowing the steam to escape is undesirable because it extends the cooking time. If the flap could be more tightly reclosed, the steam thus trapped inside the container would tend to cook the product faster.

Rather specialized machinery, not presently installed in most food packaging facilities, is required to fold, fill and seal the above-described *top* fillable, microwavable and/or ovenable container. The typical packaging facility has machinery in place for folding, filling and sealing conventional *end* fillable containers. However, such containers are not microwavable or ovenable, in part, because they are not leakproof. Conventional end fillable containers are provided with four simple flaps on each end, one of the flaps usually being relatively narrow (i.e., less than one fourth the width of the opposite flap on that end). Even if such flaps were thermally sealed, liquid would certainly leak through the corners once the product was warmed in an oven.

In consideration of the above-described problems of known prior art food packaging containers, it is a primary object of this invention to provide an end fillable container which may be placed directly in a microwave and/or conventional oven for heating the product contained therein.

Further objects of this invention are to provide an end fillable food packaging container that may be opened by the consumer, yet remain leakproof while used to hold food heated in a microwave and/or conventional oven; to provide an end fillable container that may be folded, filled and sealed on presently available machinery that is designed to be used with conventional end fillable containers (requiring only minor changes to the machinery); to provide a method for folding, filling and sealing an end fillable microwavable and/or ovenable container; to provide a flap on an end fillable microwavable and/or ovenable container that may be more tightly reclosed by a consumer of the product packaged therein, as compared to the flap provided on conventional top filled microwavable, ovenable containers; to provide such a container effective to store "left over" food products that have been partially consumed; to provide such a container which when reclosed, is easier to handle with less chance of spilling its contents; to provide a container in which food may be cooked more quickly than in conventional containers which vent steam; to provide a container with more conveniently displayed cooking instructions and with graphics unmarred by tear lines; and, to provide an end fillable microwavable and/or ovenable container with a conventional reclosable flap for use in heating products for which it is preferable that the flap not be tightly closed, so that steam may escape during the cooking process.

These and other objects of the invention will be apparent to those of ordinary skill in the art to which this invention pertains, by reference to the attached drawings and the disclosure of the preferred embodiments that follow hereinbelow.

SUMMARY OF THE INVENTION

A container accomplishing the objects noted above, i.e., one which is filled with a food product through one end prior to being sealed, and which is adapted to hold the food product while it is heated in a microwave or conventional oven, a blank from which the container may be formed, and a method for assembling such a container from a pre-cut blank, are claimed as the subject invention. The container includes a bottom panel and a top panel, both panels having four edges, each defined by a fold line. It further includes a front sidewall, a rear sidewall, a first and a second end wall, a first and a second end flap, and a front flap. The top panel is connected along fold lines disposed at opposite edges to the front sidewall and to the rear sidewall, and along fold lines at two other edges to the first and second end wall, respectively. The front and rear sidewalls and the first and second end walls are all connected by four gusseted corners.

In a similar fashion, the bottom panel is connected along fold lines disposed at opposite edges to the rear sidewall and the front flap, and along fold lines at two other edges to the first and second end wall, respectively. The bottom panel has a tear-open access flap defined by a first pair of partially die cut lines disposed on an inner surface thereof and a second pair of partially die cut lines disposed on the outer surface thereof. The first and the second partially die cut lines extend generally parallel to and offset from each other from the rear sidewall toward the front flap and terminate at a perforation line which defines a reclosure tab that is disposed on the front flap. One of the fron flap and the front sidewall is folded to overlie the other and is thermally bonded and sealed to it. Likewise, one of the first end wall and first end flap is folded to overlie the other and is thermally bonded and sealed thereto. Similarly, after the container is filled with the food product, one of the second end wall and second end flap is folded to overlie the other and the two are thermally bonded and sealed to each other. Thus, the top panel, the first and the second end walls, the front and the rear sidewalls, and the four gusseted corners together define a generally integral leakproof tray for holding the food product while it is heated in the microwave or conventional oven.

In one embodiment of the invention, the front sidewall overlies the front flap and is thermally bonded to it. The container of this embodiment further includes a tab receiver disposed on the front sidewall, defined by a pair of perforated lines; a slot disposed in the tab receiver overlies the reclosure tab. The reclosure tab is connected to the access flap at the fold line along which the front flap adjoins the top panel. Terminating at that fold line are the first and second partially die cut lines which define the access flap. It is at these two points, spaced apart by the width of the reclosure tab, that a first and a second shoulder are formed. Once the access flap has been opened, it is reclosed by forcing it between the first and second shoulders in an interference fit, such that friction between the first and second shoulders and the access flap, and between the reclosure tab, the tab receiver and the slot holds the flap in close sealing contact with the top panel. This feature enables the container to retain steam, reducing the time required to heat the product enclosed within the container in a microwave or conventional oven, and also helps to retain moisture in the food product during the cooking process.

In another embodiment of the invention, the front flap overlies the front sidewall and the first and second end walls are respectively closed over each end prior to folding and sealing the corresponding end flaps thereto. A slot in the front sidewall is operative to receive the reclosure tab; however, because of the position of the slot and relative geometry of the reclosure tab, the access flap cannot be reclosed tightly against the top panel as in the first embodiment.

A method for assembling the container includes the steps of folding a pre-cut blank along one of the fold lines that define the rear sidewall, so that the bottom portion at least partially overlies the top portion. Thereafter, one of the front sidewall and front flap is folded over the other and bonded and sealed thereto. The blank is then folded along the fold lines so that it assumes a generally box-like shape having two open ends, and four sides. One of the end flap and corresponding end wall is folded over an open end and the other is folded over it, bonded and sealed to it, thereby closing one end of the container.

After the container is filled through the remaining open end, one of the end flap and end wall at that end is folded over the opening and the other of the end flap and end wall is folded over it and sealed to it. The method also encompasses the first and second embodiments as briefly described above.

BRIEF DESCRIPTION OF THE DRAWINGS

FIG. 15 is a perspective view of the first embodiment, illustrating the manner in which a reclosure tab is accessed.

FIG. 16 is a partially cutaway perspective view of the first embodiment after an access flap has been torn open to expose the enclosed product.

FIG. 17 is a perspective view of the first embodiment wherein the cover flap has been reclosed by insertion of the reclosure tab into a slot.

FIG. 18 is an enlarged, cutaway perspective view of the portion of FIG. 17 showing the tab engaged in the slot.

FIG. 19 is an enlarged elevational view of the tab engaged in the slot as shown in FIGS. 17 and 18.

DETAILED DESCRIPTION OF THE PREFERRED EMBODIMENT

Figure 1:
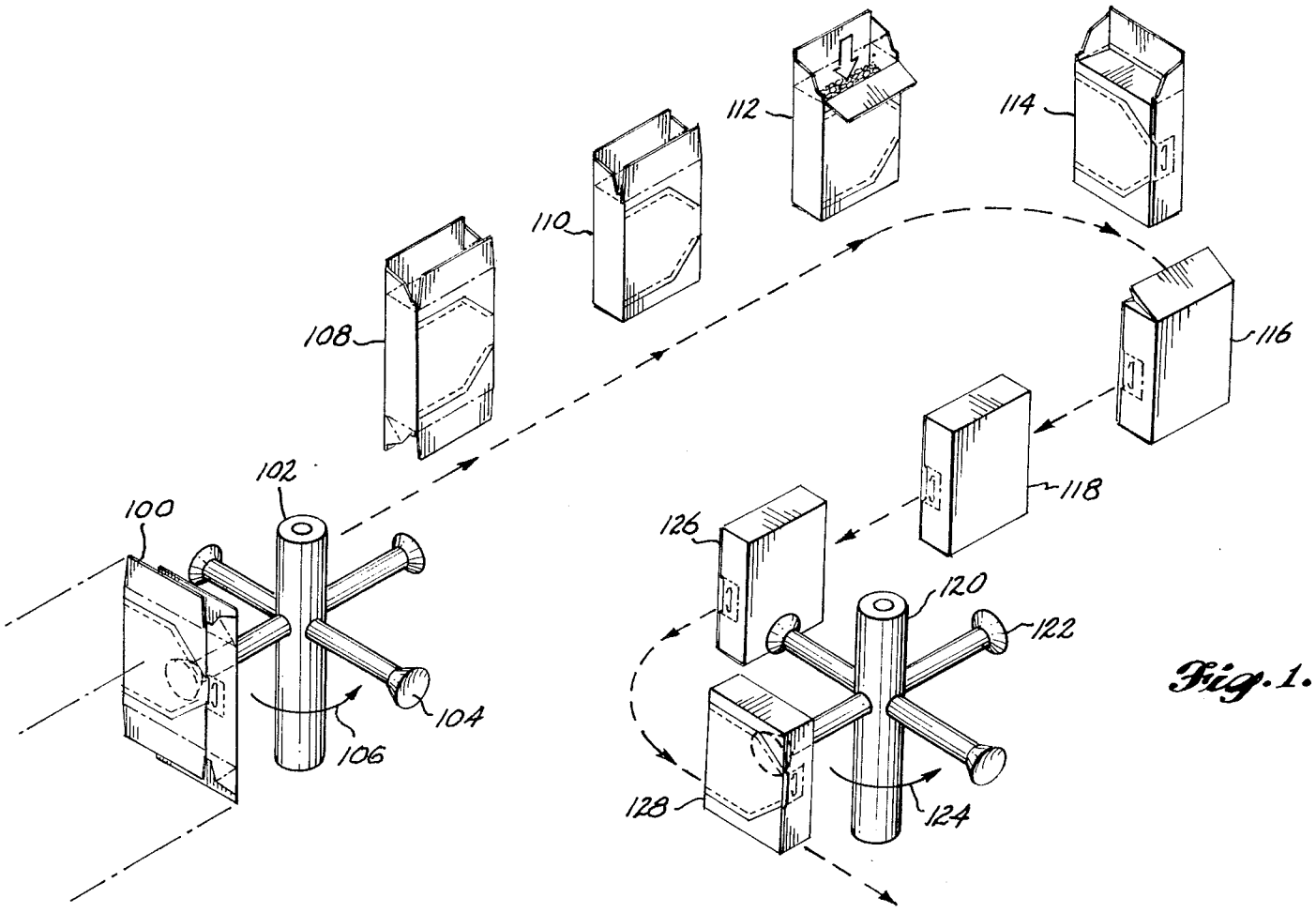
FIG. 1 is a schematic illustration showing the steps performed on a first embodiment of the invention, by a generally conventional machine for folding, filling and sealing and fillable containers.

With reference to FIG. 1, a schematic representation showing the various stages of processing a first embodiment of the present invention is shown, using a generally conventional machine designed to fold, fill and seal end filled containers. For use with containers representing the first embodiment (and the second), such a machine must be slightly modified as will be noted hereinbelow. An example of a suitable machine for this purpose would be the FMC Marapak machine provided with a heat sealing conversion. The changes required to use the above-noted machine for folding, filling and sealing the container representing the present invention are relatively simple, low in cost, and easily understood and carried out by persons of ordinary skill in the art when provided the disclosure contained herein.

A pallet containing partially assembled and sealed container blanks 100 (representing the first embodiment of the subject invention) are loaded into the processing machinery on the left side as shown in FIG. 1. A rotary suction manipulator 102 includes a plurality of suction arms 104 which use a vacuum to pick up and carry blanks 100 one at a time, as they are indexed from the pallet. Rotary manipulator 102 carries each blank 100 in the direction shown by arrow 106 to a point where the blank is picked up by a conveyor belt for transport through a series of processing stations.

As blank 100 enters the conveyor, it is unfolded into a box-like three-dimensional container as represented by reference number 108. The conventional machinery is modified as required to fold and thermally seal the lower flaps on container 108. An electric hot air blower or gas fired heat sealing system is typically used for thermally bonding and sealing such flaps together by thermally melting a coating applied to each of their respective surfaces. Alternatively, a suitable glue or adhesive may be used to seal and bond overlying surfaces of the flaps and end walls to each other. Container 110 then passes to the next station where a further modification to the machine makes it operative to fold a top flap outwardly away from the interior as shown on the container represented by reference numeral 112, so that the container may be more readily filled with a food product.

At the next station, container 114 is shown after the flap previously folded outward has been folded back over the top of the food product. Thereafter, as shown on container 116, the outer flap is folded down, and then heat sealed resulting in container 118. A second rotary suction manipulator 120 which also includes a plurality of suction arms 122 rotates in the direction of arrow 124, and is operative to convey filled and sealed containers 126 onto a second conveyor (not shown), which carries the containers 128 to an inspection and boxing station.

Figure 2:
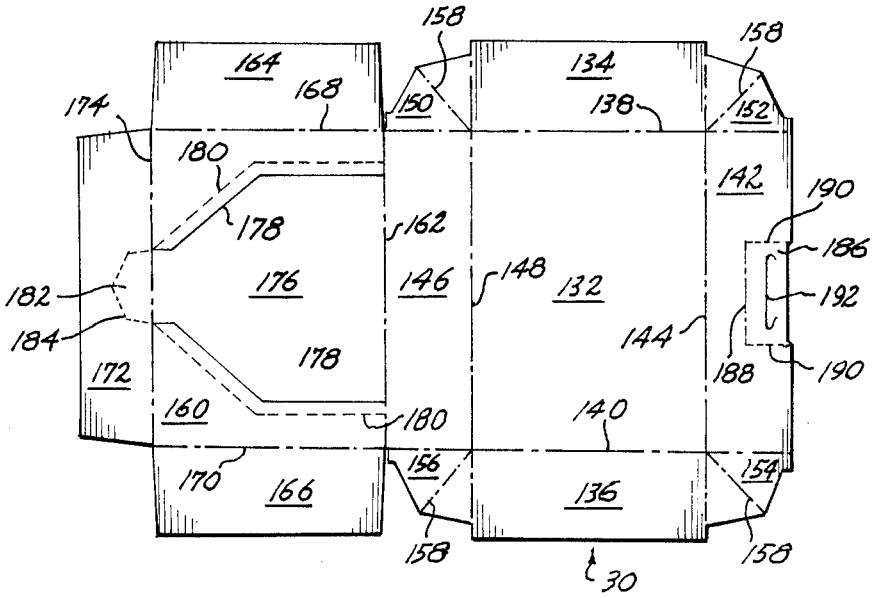
FIG. 2 is a plan view of an unfolded blank used for the first preferred embodiment of the present invention.

Turning now to FIG. 2, the first embodiment of the present invention is shown as it is first blanked from paperboard coated with polyethylene plastic or other waterproof material suitable for use in a microwave oven (or polyester plastic or other waterproof material suitable for use in either a microwave or a conventional oven). Those skilled in the art will understand that the coating selected will depend on the intended use of the resulting container. The blanked carton is generally denoted by reference numeral 130. It is helpful to note at this point that the container to be assembled from blank 130 is used in one of two orientations, the first being that in which it is typically displayed in the frozen food case of a market for purchase by a consumer, and the second being the orientation in which it is placed in a microwave oven for purposes of heating and cooking the product contained therein.

In disclosing both the first and second embodiments, the terms "top" and "bottom" refer to opposite surfaces of the container, relative to its orientation for purposes of display, with imprinted graphics on the top surface facing upward. With that understood, blanked carton 130 includes a "top" panel 132 having a second end wall 134 and a first end wall 136 separated therefrom by scored fold lines 138 and 140, respectively. A front closure sidewall 142 is separated from top panel 132 by scored fold line 144, and a rear sidewall 146 is separated from top panel 132 by scored fold line 148.

Four gusset corner sections 150, 152, 154, and 156 connect front sidewall 142 and rear sidewall 146 to end walls 134 and 136, and each includes a scored fold line 158 that intersects fold lines 138, 140, 144, and 148 at approximately a 45 degree angle.

Also connected to rear sidewall 146 (along an edge opposite that along which it is connected to the bottom panel 132) is a bottom panel 160; it is separated from rear sidewall 146 by a scored fold line 162. Appended at each end of bottom panel 160 are first and second end flaps 166 and 164, defined by scored fold lines 170 and 168, respectively. Finally, a front flap 172 is connected to bottom panel 160 along scored fold line 174 at an edge opposite rear sidewall 146.

In the first preferred embodiment, end flaps 164 and 166 are each approximately equal in dimension to end walls 134 and 136. To construct a properly sealed container, end flaps 164 and 166 should be about the same length and at least one-half the width of end walls 134 and 136, respectively.

In the preceding paragraphs, the elements comprising blank 130 have been described relative to the fold lines which define them and along which they are folded during construction of the container. Blank 130 also includes an access flap 176 which can be opened and tightly reclosed by the consumer either prior to or during the cooking process. This feature will be described in greater detail hereinbelow. Flap 176 is in part defined by a pair of partially die out (or reverse out) lines 178 and 180 which are parallel and spaced apart by about ¼". Line 178 is partially die out through the "inner" side of blank 130, while line 180 is partially die out through the "outer," or opposite side. In addition, access flap 176 includes a reclosure tab 182 that is defined by perforated line 184.

A slotted tab receiver 186 is provided on front sidewall 142, and is defined by a scored fold line 188 and perforations 190 disposed on each side thereof. Approximately centered in slotted tab receiver 186 is a slot 192.

Figure 3:
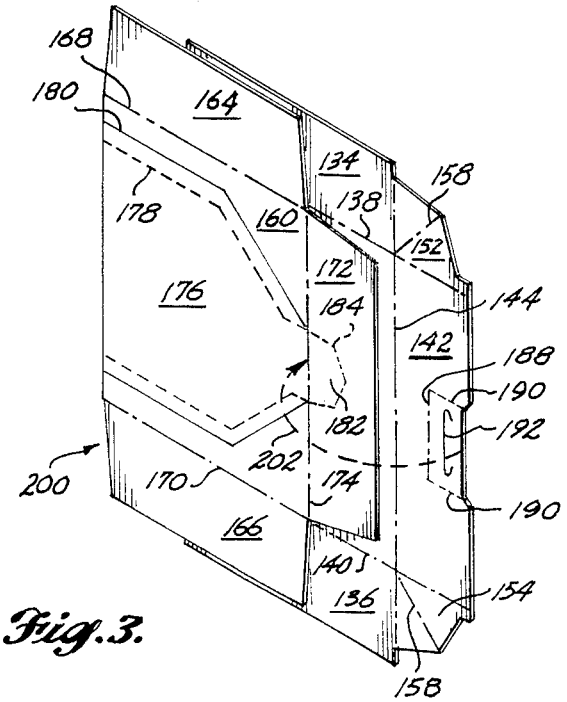
FIG. 3 illustrates the first preferred embodiment in perspective view, following an initial fold, and further illustrates the manner in which one flap is folded over another to be sealed.

With reference to FIG. 3, flat blank 130 has been folded along scored fold line 162 to form a folded blank, generally denoted by reference numeral 200. Curved arrow 202 illustrates the manner in which front sidewall 142 is folded along scored fold line 144 and thermally bonded and sealed to front flap 172, except in that area where slotted tab receiver 186 overlies reclosure tab 182. The area of front flap 172 immediately adjacent reclosure tab 182 and under slotted tab receiver 186 is printed with an ink or adhesive so that it does not easily bond to the overlying surface of the tab receiver. In addition, the area of slotted tab receiver 186 is debossed, while a corresponding area around reclosure tab 182 is embossed to prevent contact between the two areas during the step in which front sidewall 142 is bonded and sealed to front flap 172. These measures assure that a bond does not occur between the tab receiver and the reclosure tab surfaces.

Figure 4:
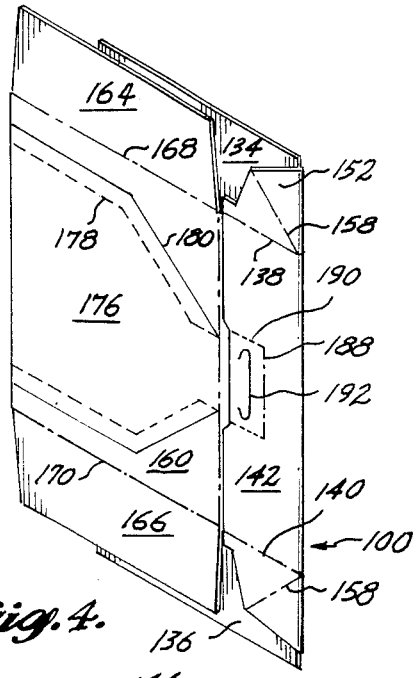
FIG. 4 shows in perspective view the first embodiment wherein the flap folded in FIG. 3 has been sealed in place.
Figure 5:
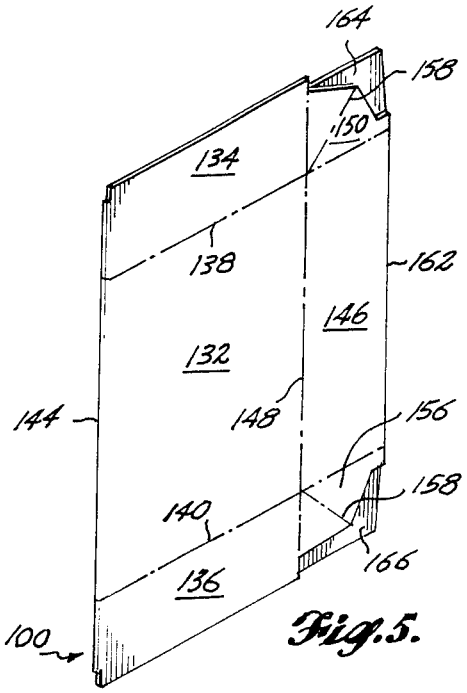
FIG. 5 illustrates in perspective view the opposite surface of the blank folded as described in FIG. 4.

The preceding folding and sealing process results in the partially assembled and sealed blank 100 which is loaded into the processing machine as previously described. Blank 100 is clearly illustrated in FIGS. 4 and 5.

Figure 6:
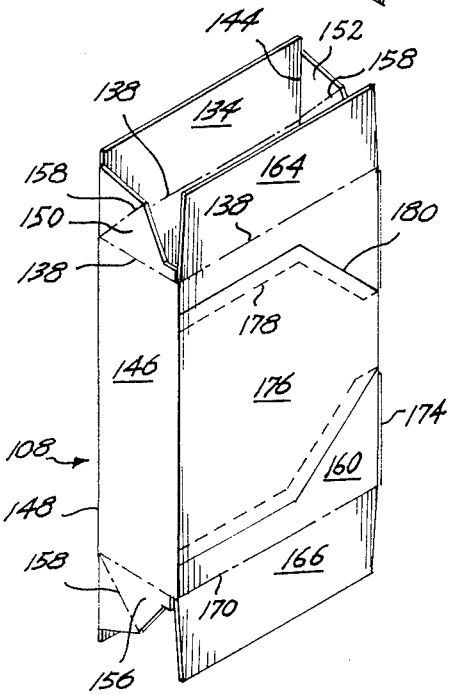
FIG. 6 illustrates the first embodiment assembled as shown in FIGS. 3 through 5, after it is unfolded from a partially assembled flat, two-dimensional blank into a three-dimensional, box-like structure.
Figure 7:
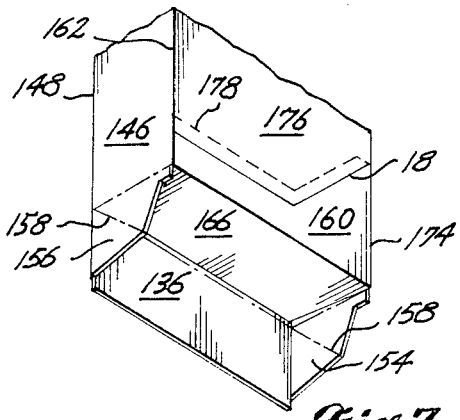
FIG. 7 illustrates in a cutaway perspective view the lower end of the container shown in FIG. 6, after an end flap has been closed.

Blank 100 is unfolded into the three-dimensional box-like container 108 by the processing machine as shown in FIG. 6. After thus unfolding container 108, the machine folds first end flap 166 inwardly along scored fold line 140 until it is approximately normal to top surface 160. This step is illustrated in FIG. 7.

Figure 8:
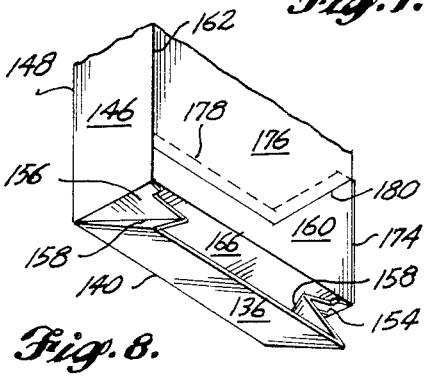
FIG. 8 is a partial perspective view showing the manner in which another end flap is closed on the bottom of the container shown in FIG. 7.
Figure 9:
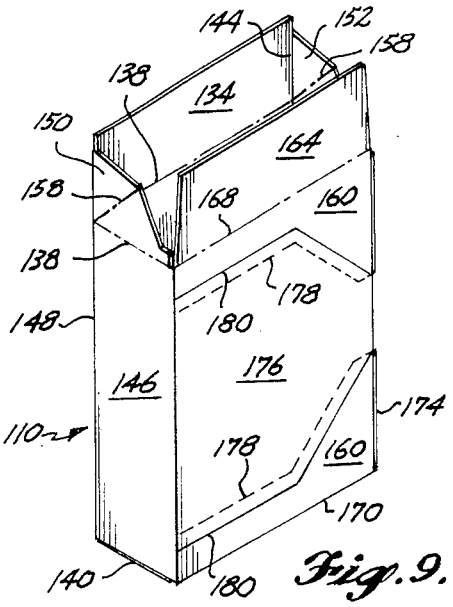
FIG. 9 is a perspective view of the container after the bottom flaps have been closed and sealed as shown in FIGS. 7 and 8.

In FIG. 8, first end wall 136 is folded along scored fold line 140, closing it over first end flap 166. During this operation, both gusset corners 154 and 156 are folded inwardly along their scored fold line 158. First end wall 136 and gusset corners 154 and 156 are thus thermally bonded and sealed to first end flap 166. This sealing operation results in container 110, as shown in FIG. 9.

Figure 10:
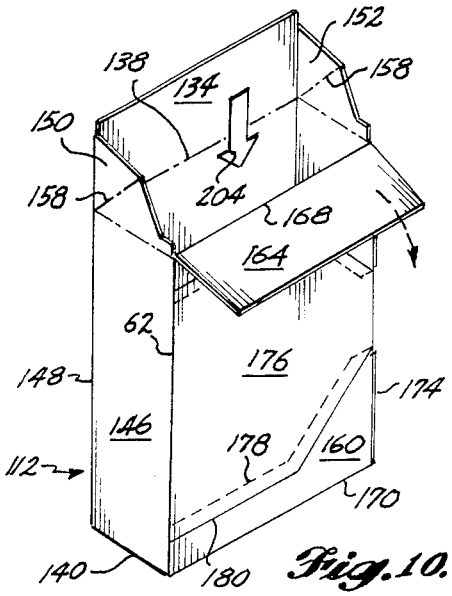
FIG. 10 is a perspective view showing how the front end flap is folded down to permit filling of the container with a product.

FIG. 10 illustrates how second end flap 164 is folded outwardly on container 112 to permit the modified processing machinery to more easily fill the container with the food product through the open upper end, as shown by arrow 204. On conventional end filled containers, use of a relative narrow flap in place of second end flap 164 obviates the need to fold the narrow flap out of the way during the filling process; however, the narrow flap would not seal as well as does second end flap 164.

Figure 11:
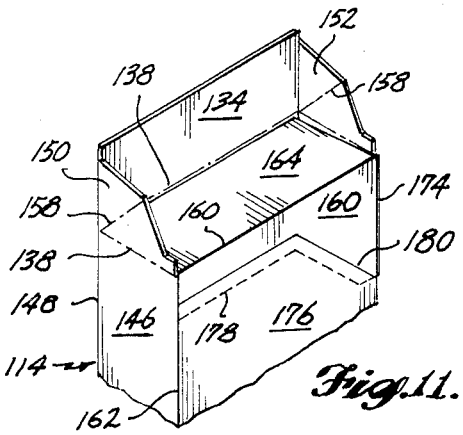
FIG. 11 is a partial perspective view showing closure of a top end flap.

Following the filling operation, the machine folds second end flap 164 inwardly along scored fold line 168, so that it is approximately normal to bottom panel 160. The resulting container 114 is shown in FIG. 11.

Figure 12:
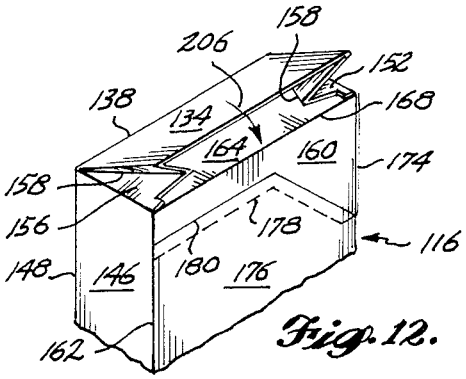
FIG. 12 is a partial perspective view of the container illustrated in FIG. 11, showing how another top end flap is closed.

Subsequently as shown in FIG. 12, end wall 134 is folded by the machine, along scored fold line 138 in the direction shown by arrow 206, so that it covers second end flap 164. During this step, gusset corners 150 and 152 are folded inwardly along their scored fold line 158. Second end wall 134 and gusset corners 150 and 152 are then sealed to second end flap 164 by thermally bonding their plastic coating.

Figure 13:
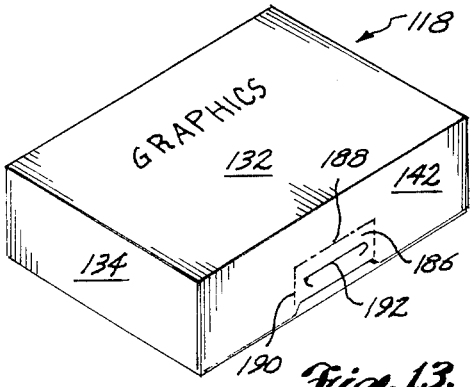
FIG. 13 is a perspective view illustrating a surface of the container box normally imprinted with advertising graphics, oriented as it is displayed to the consumer.

With reference to FIG. 13, container 118 is shown oriented with top panel 132 facing upwardly, as it would be when the product is displayed in the supermarket. In this orientation, graphics imprinted on the outside surfaces of top panel 132 and end walls 134 and 136, e.g., photographic or artistic renditions of the enclosed product, are clearly visible to the consumer and not impaired by any partially die cut or perforated lines, providing improved marketability of the product.

Figure 14:
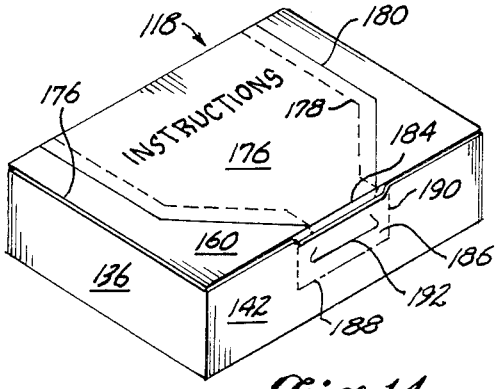
FIG. 14 illustrates in perspective view an opposite orientation of the first embodiment from that shown in FIG. 13, wherein the container is oriented as it would be when placed in a microwave or conventional oven for heating the enclosed product.

When the consumer is ready to heat the product contained within container 118 in a microwave or conventional oven, the container is turned over so that bottom panel 160 faces upwardly as shown in FIG. 14. This exposes instructions for heating the product that are imprinted on bottom panel 160 so that the consumer can easily read them, even after the cooking process has been initiated. This is a novel advantage compared to conventional microwavable or ovenable containers on which cooking instructions are usually provided on the bottom of the container as it is oriented for heating the product.

During the heating process, container 118 must be oriented as shown in FIG. 14 to avoid leakage of the enclosed product at the corners of bottom panel 160. When the product is frozen or near frozen (as it is when container 112 is filled), sauces, juice, and other liquids that comprise a portion of the product are either in solid form, as ice crystals, or so viscous that they cannot leak through the corners of bottom panel 160. Thus, the orientation of container 118 is irrelevant so long as the product contained therein remains frozen or nearly frozen. However, once the heating process is initiated, panel 160 must face "up" so that liquid associated with the product cannot escape through any small holes or crevices that may exist at its corners.

In any case, most food products marketed within container 118 will require that access panel 176 be opened prior to initiation of the cooking process. For this reason, container 118 will be oriented for heating as shown in FIG. 14, wherein the upper portion of the container comprises a generally leakproof tray.

FIG. 15 illustrates the manner in which the consumer gains access to the food product contained within container 118. Slotted tab receiver 186 is folded downwardly along scored fold line 188, tearing along perforated lines 184. This action exposes reclosure tab 182. Tab 182 is initially pushed inward to tear along perforated lines 190. By grasping reclosure tab 182 and the adjacent end of access flap 176 together between the thumb and forefinger of one hand and holding down on the corners of bottom panel 160 with the other hand, the consumer tears open access flap 176 along partially die cut lines 178 and 180 in the direction of arrow 208, folding the flap back along scored fold line 162. FIG. 16 illustrates container 118 with access flap 176 in a fully open position.

After adding butter, water, and/or other seasonings and liquids, access flap 176 can be reclosed by folding it downwardly about scored fold line 162 and inserting reclosure tab 182 into slot 192 as illustrated in FIGS. 17, 18 and 19. Access flap 176 is normally opened prior to initiation of the process for heating the product in a microwave oven, and is then reclosed for the entire heating process or at least a portion thereof. Since the instructions for heating the product are imprinted on upwardly facing panel 160, they are readily available to the consumer. This is particularly important where the cooking process involves two or more steps, e.g., where the product must be first heated with access flap 176 closed for a first time interval at a prescribed microwave oven cooking power level, followed by a second time period with the access flap open—perhaps at a different power level.

The design of access flap 176, reclosure tab 182, and slotted tab receiver 186 provides a relatively tighter seal upon reclosure of access flap 176 than do any of the comparable known prior art designs. Details of this novel reclosure of access flap 176 are best shown in FIGS. 18 and 19. As previously noted, to reclose flap 176, reclosure tab 182 is inserted into slot 192 and access flap 176 is seated in a relatively tight seal against bottom panel 160 by pushing downwardly along scored fold line 174. This downward pressure forces the portion of access panel 176 that is adjacent to scored fold line 174 into an interference fit with a first and a second shoulder 212 and 214, disposed along fold line 174 where partially die cut lines 180 terminate at perforation 184. In addition, the length of slot 192 is selected so that there is an interference fit between its ends and the edges of reclosure tab 182 (which are angled toward each other). Further, reclosure tab 182 is stressed outwardly as it passes over the top portion of receiver 186 and into slot 192, thus increasing the frictional force between contacting surfaces of the tab and receiver. The friction resulting from both sources of interference fit and the friction between reclosure tab 182 and of slotted tab receiver 186 all help to hold access flap 176 tightly against bottom panel 160, providing a relatively tight seal along the areas 216 which extend between partially die cut lines 178 and 180 and which define an area of overlap between the access flap and the bottom panel. This seal acts to prevent steam from escaping container 118 during the microwave cooking process, and thereby reduces the time necessary to heat the enclosed product. In addition, the seal retains product moisture and permits container 118 to be used for storage of the food product after access flap 176 has been opened.

If venting of the steam is required, as it is for certain food products, access flap 176 can be left fully opened, or partially opened (i.e., by not fully sealing reclosure tab 182 within slot 192, and by not forcing the portion of access flap 176 adjacent scored fold line 174 into an interference fit with shoulders 212 and 214).

The second embodiment of the present invention lacks the improved reclosure tab 182 and slotted tab receiver 186 of the first embodiment and is folded in a different sequence. In addition, it moves through the processing machinery with its top panel facing the opposite direction, as may be seen by comparison of FIGS. 1 and 20.

Figure 20:
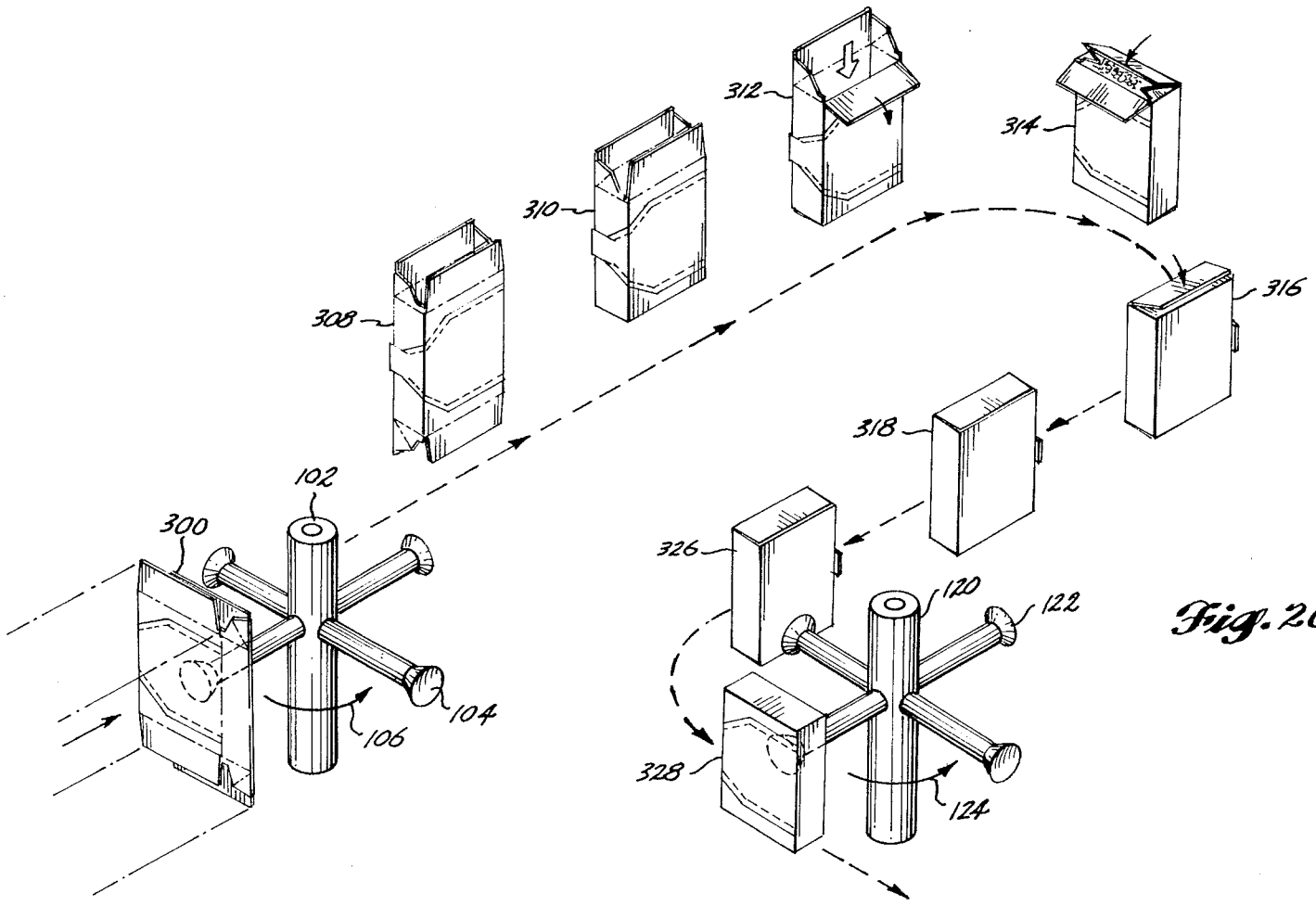
FIG. 20 is a generally schematic view illustrating the steps by which a second embodiment of the invention is folded, filled and sealed.

Referring now to FIG. 20, a pallet containing partially folded and assembled blanks 300 of containers comprising the second embodiment of the invention enter the processing machinery from the left, as viewed in the referenced figure. Rotary suction manipulator 102 is operative to convey containers 300 one at a time, as they are individually indexed forward on the pallet, in the direction of arrow 106 around to a conveyor line (not shown) where the container is unfolded into a three-dimensional box-like shape 308, having open top and bottom ends. The flaps on the bottom are folded inwardly one over the other and sealed to provide container 310. Thereafter, one of the top flaps is folded outwardly and container 312 is filled with the product. On container 314, the top flap having gusset corners has been folded inwardly to cover the product contained therein, and, as shown for container 316, the other top flap is folded over it and sealed, producing container 318. Suction arm 122 on rotary suction manipulator 120 conveys a filled and sealed container 326 in the direction of arrow 124 to a point where, as shown, container 328 is moved down a conveyor line (not illustrated) for final inspection and packaging for shipment.

Figure 21:
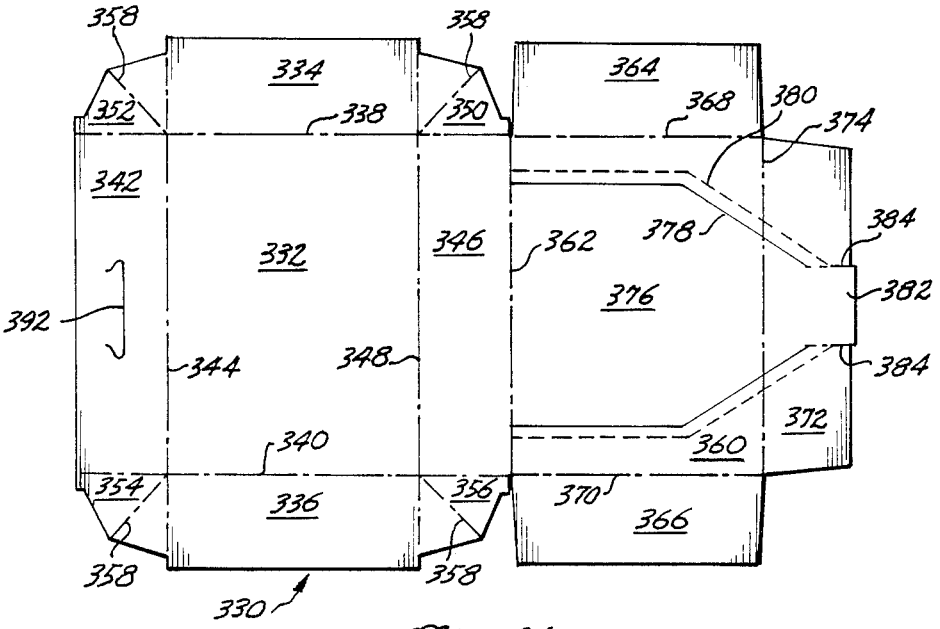
FIG. 21 shows a plan view of an unfolded blank used for the second embodiment of the invention.

With reference to FIG. 21, an unfolded blank 330 representing the second embodiment of the present invention is shown. Blank 330 is formed of the same waterproof coated paperboard material as the first embodiment. In referring to the second embodiment, the same convention applies with regard to "top" and "bottom," as were previously explained.

On blank 330, a top panel 332 is appended to first and second end walls 336 and 334 along scored fold lines 340 and 338, respectively. A front sidewall 342 is likewise defined along an edge of top panel 332 by scored fold line 344, and along the opposite edge, scored fold line 348 separates back sidewall 346 from top panel 332.

Four gusseted corners 350, 352, 354 and 356 connect end walls 334 and 336 to front sidewall 342 and rear sidewall 346, and each include scored fold line 358 directed at an approximate angle of 45 degrees relative to scored fold lines 338, 340, 344 and 348.

A top panel 360 is connected to back sidewall 346 along scored fold line 362. First and second end flaps 366 and 364 are appended to top panel 360 along scored fold lines 370 and 368, respectively. And finally, a front flap 372 is hingedly connected to top panel 360 along scored fold line 374.

End flaps 364 and 366 are about equal in dimension to end walls 334 and 336; in any case, it is preferred that they be approximately the same length and at least one-half the width to insure an adequate seal when the container is assembled.

The second embodiment of the present invention has an access flap 376 which is configured somewhat differently than access flap 176 of the first embodiment. Flap 376 is similarly defined in top panel 360 by parallel partially die cut (also referred to in the art as reverse cut) lines 378 and 380, that are spaced apart from each other by about one-fourth inch and extend from fold line 362 toward front flap 372. A reclosure tab 382 is defined by perforated lines 384 at the points where lines 380 terminate on each side thereof. On the opposite edge of blank 330, a slot 392 is provided in front sidewall 342.

Figure 22:
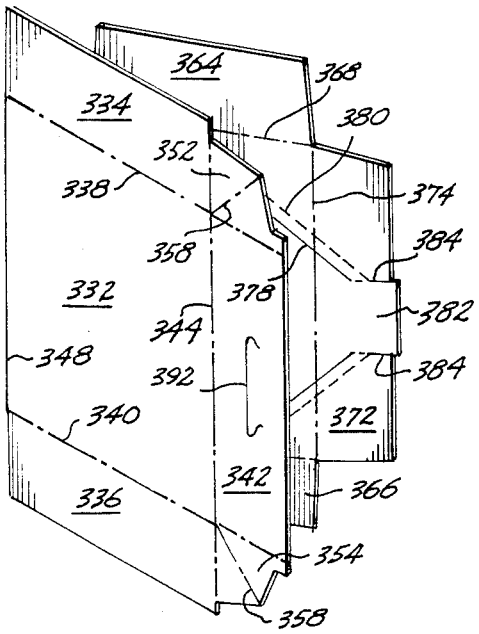
FIG. 22 illustrates in a perspective view a first fold of the blank shown in FIG. 21.
Figure 23:
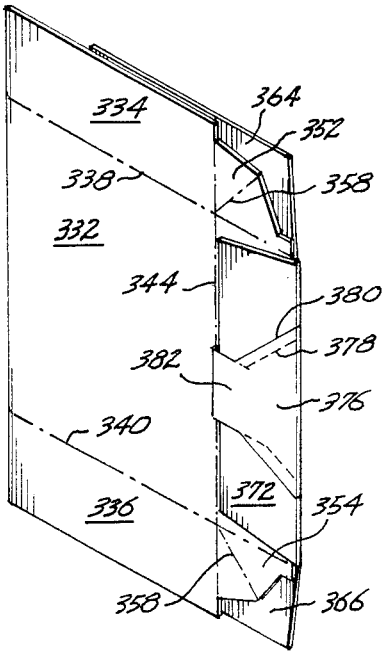
FIG. 23 illustrates the second embodiment, showing how a side flap is folded and sealed to another side flap.

FIG. 22 illustrates the manner in which bottom panel 332 is folded over along fold line 348 to overlie top panel 360, as an initial step in constructing the container. In FIG. 23, front flap 372 is folded along scored fold line 374 so that it overlies front sidewall 342. The adjacent overlapping surfaces of front flap 372 and front sidewall 342 are thermally sealed and bonded to each other except where reclosure tab 382 overlies front sidewall 342. The application of ink or adhesive to the overlying surfaces, combined with the debossing of tab 382 and embossing of the area of sidewall 342 that is beneath it are used to prevent bonding of these surfaces, as previously explained for the first embodiment. (Thermally bonding the coatings of overlapping surfaces is a preferred method of sealing for the second embodiment; however, a suitable adhesive may also be used.)

Figure 24:
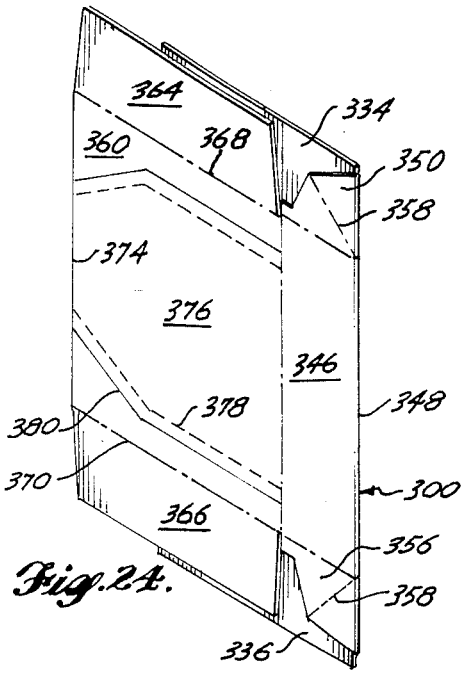
FIG. 24 illustrates in a perspective view, the second embodiment following the folding and sealing operation shown in FIG. 23.
Figure 25:
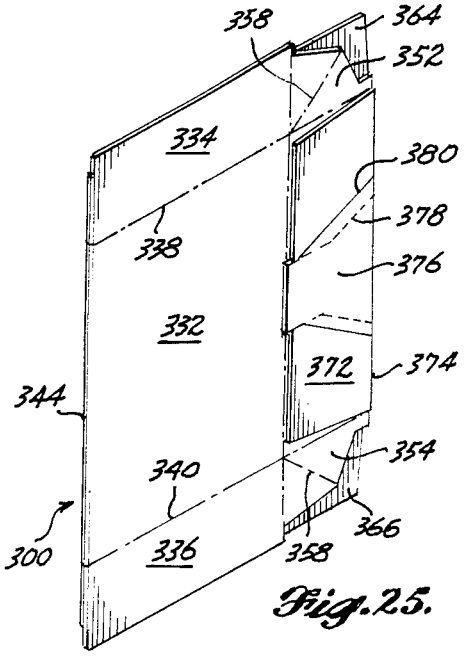
FIG. 25 shows in perspective view the opposite surface of the second embodiment relative to that illustrated in FIG. 24.
Figure 26:
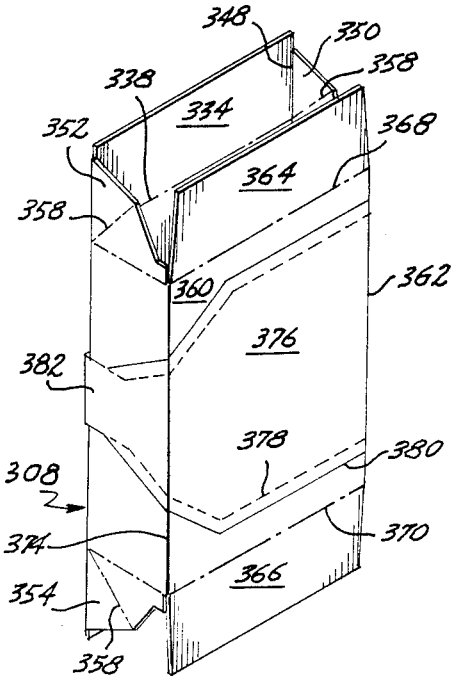
FIG. 26 shows the second embodiment in a perspective view after the partially assembled container illustrated in FIGS. 23 through 25 is unfolded into a three-dimensional box-like structure.
Figure 27:
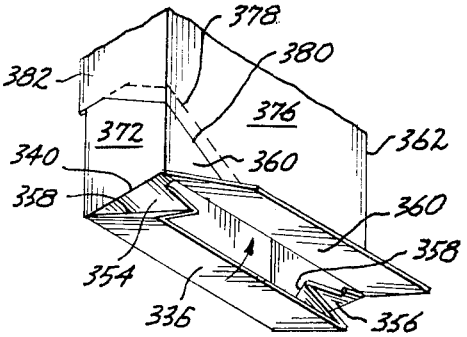
FIG. 27 shows a partial perspective view of the bottom of the second embodiment after an end flap has been folded inwardly.
Figure 28:
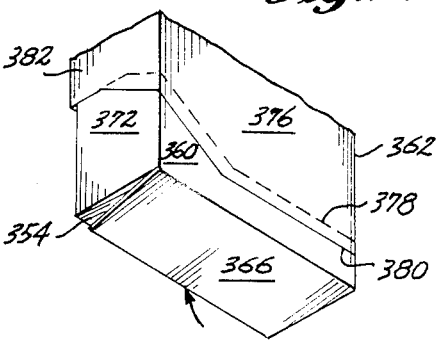
FIG. 28 shows in a perspective view, the manner in which another end flap is folded.

Following this initial folding and sealing process, blank 300 results as is shown in FIGS. 24 and 25. Blank 300 is unfolded by the processing machine into the three-dimensional, open-ended box-like container 308, illustrated in FIG. 26. As the next step in the folding process, the machine folds first end wall 366 inwardly along scored fold line 340 so that it is approximately normal to the surface of top panel 360. This operation is clearly illustrated in FIG. 27. As part of the last noted folding operation, gusset corners 354 and 356 are folded inwardly along their scored fold lines 358. Thereafter, as shown in FIG. 28, first end flap 366 is folded along scored fold line 370 in the direction shown by the arrow, over first end wall 336. The inner surface of first end flap 366 is. This sealing operation also bonds gusset corners 354 and 356 to the inner surface of end wall 336.

Figure 29:
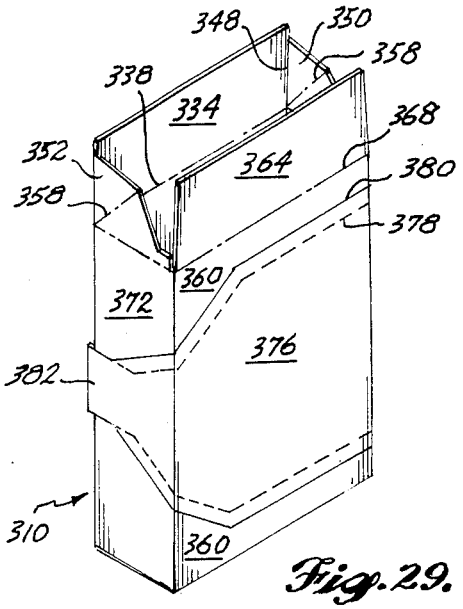
FIG. 29 is a perspective view of the second embodiment after the bottom two end flaps have been folded and sealed.
Figure 30:
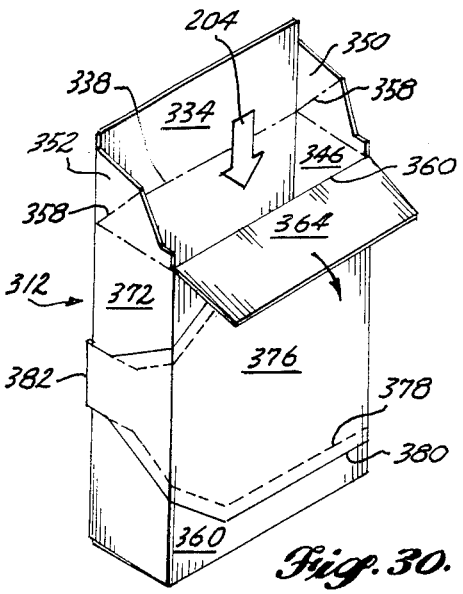
FIG. 30 illustrates in a perspective view how the front end flap is folded outward to facilitate filling the container with a product.

FIG. 29 shows container 310 following closure and sealing of the first end flap 366 to first end wall 336. In FIG. 30, second end flap 364 of container 312 is folded outwardly, preparatory to filling the container with the product to be enclosed therein, as illustrated by arrow 204. The second end flap thus does not interfere as the product is funneled into container 312.

Figure 31:
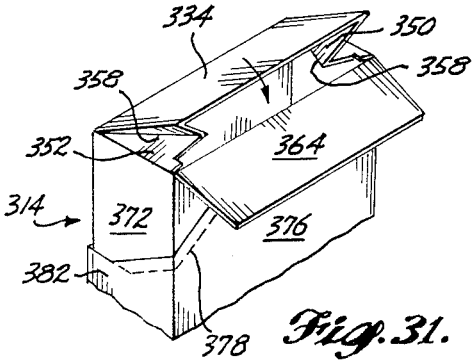
FIG. 31 shows a partial perspective view of the top of the second embodiment after the rear end flap has been folded inwardly.
Figure 32:
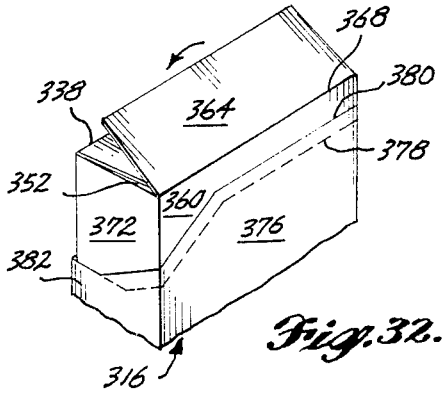
FIG. 32 is a partial perspective view of the top of the second embodiment illustrating the manner in which another end flap is folded over the open end.

Filled container 314 is illustrated in FIG. 31, wherein second end wall 334 has been folded inwardly along scored fold line 338. During this operation, gusset corners 350 and 352 are folded inwardly along scored fold lines 358. Subsequently, as shown in FIG. 32, second end flap 364 is folded along scored fold line 368 so that it overlies second end wall 334. The overlying inner surface of second end flap 364 is sealed and bonded to the underlying surface of second end wall 334 and gusset corners 350 and 352 are sealed in place in the manner noted previously.

Figure 33:
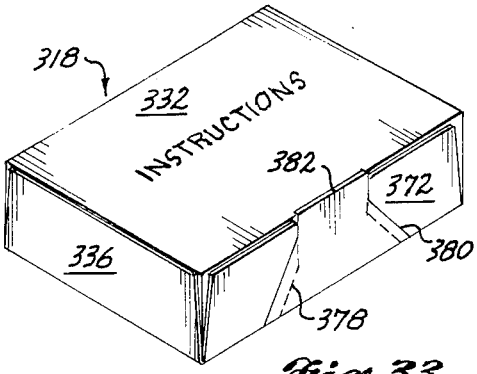
FIG. 33 illustrates in perspective view the second embodiment, showing a surface of the container on which are normally imprinted instructions for heating the enclosed product.
Figure 34:
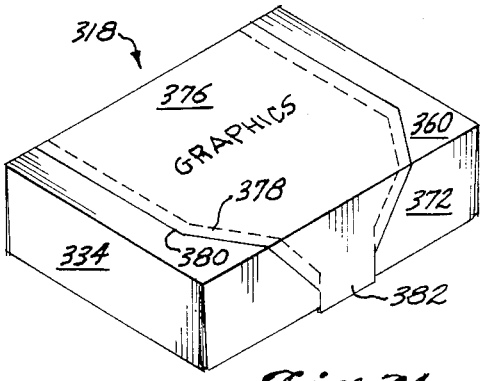
FIG. 34 shows the second embodiment in a perspective view, oriented as it would be when placed in a microwave oven for cooking the enclosed product and showing the surface normally imprinted with advertising graphics.

A filled and sealed container representative of the second embodiment of the invention is shown in FIG. 33 in the orientation wherein instructions for heating the product printed on bottom panel 332 are visible to the consumer. Since the product enclosed within container 318 is in a frozen state from the time the container was filled, liquids associated with the product are either very viscous or completely frozen, and cannot run out through the corners of top panel 360 when inverted as shown in FIG. 33. When the consumer has read the instructions and is ready to heat the product enclosed within container 318, the container is placed in the oven in the same orientation in which it was displayed for marketing, shown in FIG. 34, wherein graphics imprinted on top panel 360 are visible. In this embodiment, instructions relating to multiple stages of cooking are not readily available to the consumer throughout the entire cooking process, and it may be inconvenient for the consumer to look at the instructions on the bottom of the package, e.g., by holding it high overhead, once the container is opened and the product is heated. Marketing considerations dictate that graphics be imprinted on top panel 360 rather than bottom panel 332, because as shown in FIG. 33, raw edges on end flap 334 and 336 and side flap 372 are exposed when panel 332 faces upward.

Container 318 is opened by the consumer simply by grasping reclosure tab 382 and pulling upwardly to separate access flap 376 from top panel 360 along partially die cut lines 378 and 380. To reclose access flap 376, reclosure tab 382 is simply inserted within slot 392. However, this leaves access flap 376 elevated above the exposed surface of top panel 360, forming a wedge-shaped gap. As explained above, this gap provides a substantial space through which steam may escape from the product during the cooking process.

Clearly, the first embodiment has a number of advantages compared to the second, e.g., tighter reclosure of the access flap and easier reference to the heating instructions during the heating process. However, both embodiments offer the consumer the advantages of a microwavable and/or ovenable container for the first time in an end fillable container.

While containers 118 and 318 have both been illustrated and described as including tear open access flaps 176 and 376, respectively, that open from a side of the container by folding along a fold line at the opposite side, it will be apparent that the access flaps might also tear open from an end and fold back toward the opposite end. For example, with regard to the first embodiment, partially die cut lines (functionally equivalent to lines 178 and 180) may extend from fold line 170 to terminate at the ends of a perforation line that defines a reclosure tab disposed on end flap 164, (equivalent to the reclosure tab 182 defined by perforation line 184). A slotted tab receiver (equivalent to tab receiver 186) may be defined by two perforation lines and a fold line on end wall 134. The "end opening access flap," "end flap reclosure tab" and "end wall slotted tab receiver" just described, would function in a manner totally analogous to access flap 176, reclosure tab 182 and tab receiver 186, respectively, to provide a tight seal upon reclosure of the end opening access flap after it has been torn open.

Likewise, the second embodiment, container 318, may be provided with an "end opening access flap" defined by partially die cut lines that extend across panel 360 from fold line 368, terminating at a reclosure tab analogous to reclosure tab 382, but instead disposed on end flap 366. This "end flap reclosure tab" would overlie a slot disposed in end wall 334, equivalent to slot 392. Such an end opening access flap, reclosure tab and slot would operate and function similarly to access flap 376, reclosure tab 382 and slot 392.

Although the subject invention has been disclosed with respect to a first and a second preferred embodiment and modifications thereto, further modifications within the scope of the claims will be apparent to those of ordinary skill in the art to which the invention pertains. Accordingly, it is not intended that the invention be limited by the disclosure or by such modifications, but instead its scope should be determined entirely by reference to the claims which follow hereinbelow.

The embodiments of the invention in which an exclusive property or privilege is claimed are defined as follows:

1. container that is filled with a product through one end prior to being sealed, and which is made with a waterproof material suitable for holding the product while it is heated in an oven, comprising:

a first panel having four edges, each defined by a fold line;

a second panel having four edges, each defined by a fold line;

a front sidewall;
a rear sidewall;
a first and a second end wall;
a first and a second end flap;
a front flap;
the first panel being connected along fold lines at opposite edges to the front sidewall and the rear sidewall, and along fold lines at two other edges to the first and the second end wall, respectively, the front and rear sidewalls and the first and second end walls all being connected by four gusseted corners;
the second panel being connected along fold lines at opposite edges to the rear sidewall and the front flap, and along fold lines at two other edges to the first and the second end flap, respectively, the second panel including a tear-open access flap defined by a first pair of partially die cut lines and by a second pair of partially die cut lines, extending generally parallel to and offset from each other toward one of the front flap and the first and second end flaps and terminating at a perforation line that defines a reclosure tab disposed on the one flap;
the front sidewall being folded to overlie the front flap and being adherently secured and sealed thereto;
one of the first end flap and the first end wall being folded to overlie the other and being adherently secured and sealed to the other, one of the second end flap and the second end wall being folded to overlie the other and being adherently secured and sealed to the other after the container is filled with the product;
a tab receiver disposed on one of the front sidewall and the end walls, defined by a pair of perforated lines, the tab receiver including a slot disposed in overlying relationship to the reclosure tab; and
the first panel, the first and the second end walls, the front and the rear sidewalls, and the four gusseted corners together defining a generally integral leak-proof tray to hold the food product for heating in the oven.

2. The container of claim 1 wherein the front sidewall overlies the front flap and the end walls overlie the end flaps.

3. The container of claim 1 wherein the reclosure tab is connected to the access flap at the fold line along which the one of the front flap and the end flaps is connected to the second panel, the first and second pair of partially die cut lines defining the access flap terminating at that fold line to form a first shoulder and a second shoulder that are spaced apart.

4. The container of claim 3 wherein the access flap fits between the first and second shoulders in an interference fit upon reclosure after being opened, so that friction between the access flap and the first and second shoulders holds the access flap in close sealing contact with the second panel.

5. The container of claim 4 wherein the perforation line defining the reclosure tab extends from the first and second shoulders, along two edges of the reclosure tab that converge, and wherein the slot has a length selected to result in an interference fit with the edges of the reclosure tab when it is inserted into the slot.

6. The container of claim 4 wherein the reclosure tab is subjected to a force directed generally normal to its surface when inserted into the slot, the force acting to increase friction between adjacent contacting surfaces of the reclosure tab and the tab receiver.

7. The container of claim 1 wherein the first end flap overlies the first end wall and the second end flap overlies the second end wall.

8. The container of claim 1 wherein the first and second end flaps each have a surface area equal to at least half that of each of the first and second end walls.

9. A generally planar pre-cut blank made from a waterproof material that may be folded and sealed to form a container which is filled with a product through an open end and which is suitable for holding the product while it is heated in an oven, the blank comprising:

(a) a first integral section adapted to serve as a leak-proof tray and including;
a first panel that is quadrilateral, having four edges defined by scored fold lines that intersect at four corners;
a first and a second sidewall connected to the first panel along the fold lines at two edges thereof that are opposite each other;
a first and a second end wall connected to the first panel along the fold lines at two other edges thereof that are opposite each other; and
foldable corner means for connecting together the first and the second sidewalls and the first and the second end walls, disposed at each of the four corners of the first panel;

(b) a second integral section adapted to serve as a cover to the first section and including:
a second panel that is quadrilateral, having four edges defined by scored fold lines, and which is connected to the second sidewall of the first section along one of the fold lines that defines an edge of the second panel;
a side flap connected along one of the fold lines to an edge of the second panel that is opposite the edge which is connected to the second sidewall, a first and a second end flap being connected to the second panel along fold lines to two other edges of the second panel that are opposite each other;
the second panel including means for defining a tear-open access flap; and (c) means for reclosing the access flap after it has been opened, including a reclosure tab defined by a perforated line disposed on one of the side flap and the end flaps and extending from the means for defining a tear-open access flap, and a tab receiver having a slot operative to receive the reclosure tab after it is opened, said tab receiver being at least in part defined by a pair of perforation lines disposed on one of the first sidewall and the end walls.

10. The pre-cut blank of claim 9 wherein the means for defining a tear-open access flap include a pair of partially die cut lines, each partially cut through opposite surfaces of the second section, the lines being generally parallel and offset from each other and extending across the second panel toward one of the side flap and the end flaps along spaced apart paths.

11. The pre-cut blank of claim 9 wherein the perforated line defining the reclosure tab extends from two points disposed on the fold line along which the one of the side flap and the end flaps is connected to the edge of the second panel, and along two edges of the reclosure tab that converge, and wherein the slot has a length less than the widest spacing between the two edges of the reclosure tab so that an interference fit between the reclosure tab and the slot results when the reclosure tab is inserted into the slot.

12. The pre-cut blank of claim 9 wherein the first and second end flaps each have a width at least one-half that of the first and second end walls.

* * * * *

UNITED STATES PATENT AND TRADEMARK OFFICE

CERTIFICATE OF CORRECTION

PATENT NO. : 4,746,019

DATED : May 24, 1988

INVENTOR(S) : Donald R. Prater

It is certified that error appears in the above-identified patent and that said Letters Patent is hereby corrected as shown below:

Column 3, Line 1, "fron" should be --front--.

Column 4, Line 2, "and" should be --end--.

Column 4, Line 66, insert --,-- (comma) after "illustrates".

Column 5, Line 11, insert --,-- (comma) after "shows".

Column 6, Line 57, "bottom" should be --top--.

Column 7, Line 50, "160" should be --132--.

Column 7, Line 64, "relative" should be --relatively--.

Column 10, Line 27, "top" should be --bottom--.

Column 10, Line 30, "top" should be --bottom--.

Column 11, Line 66, "flap" should be --flaps--.

Column 11, Line 67, "side" should be --front--.

Column 12, Line 61, Claim 1, line 1, insert --A-- before "container".

Column 14, Line 13, Claim 9, line 7, ";" should be --:--.

Column 14, Line 54, "spaced apart" should be --spaced-apart--.

Signed and Sealed this

Twenty-first Day of February, 1989

*Attest:*

DONALD J. QUIGG

*Attesting Officer*

*Commissioner of Patents and Trademarks*